United States Patent [19]

Imagawa et al.

[11] Patent Number: 4,463,863

[45] Date of Patent: Aug. 7, 1984

[54] CLOSURE INCLUDING AN IMPROVED LINER

[75] Inventors: Noriyuki Imagawa, Ishioka; Nobu Utsunomiya, Hiratsuka, both of Japan

[73] Assignee: Toyo Seikan Kaisha, Ltd., Tokyo, Japan

[21] Appl. No.: 214,975

[22] Filed: Dec. 10, 1980

[30] Foreign Application Priority Data

Dec. 19, 1979 [JP] Japan ..... 54-164026

[51] Int. Cl.[3] ..... B65D 53/04

[52] U.S. Cl. ..... 215/343

[58] Field of Search ..... 215/343, 345, 341

[56] References Cited

U.S. PATENT DOCUMENTS

| | | | |
|---|---|---|---|
| 2,957,595 | 10/1960 | White | 215/345 X |
| 3,195,754 | 7/1965 | Brockett | 215/343 X |
| 3,300,072 | 1/1967 | Caviglia | 215/345 |
| 3,883,025 | 5/1975 | Jemmett | 215/341 |
| 4,114,775 | 9/1978 | Shinozaki | 215/343 X |
| 4,256,234 | 3/1981 | Mori | 215/343 |

*Primary Examiner*—Donald F. Norton

*Attorney, Agent, or Firm*—Pennie & Edmonds

[57] ABSTRACT

A closure having a metal shell (2) and a synthetic resin liner (4). The liner has at least one annular projection (10). The diameter of the liner is less than the diameter of a skirt (8) depending from a top surface (6) of the shell so that a space is formed between the skirt and the liner. A tab (16) extends into the space.

1 Claim, 6 Drawing Figures

CLOSURE INCLUDING AN IMPROVED LINER

TECHNICAL FIELD

This invention relates to a closure for a container and more particularly to a closure of a type that has a metal shell including a circular top surface, a substantially cylindrical skirt depending therefrom and a synthetic resin liner press formed inside the top of the shell.

CROSS-REFERENCE TO OTHER APPLICATIONS

This application relates to an improvement of a closure construction disclosed in co-pending application Ser. No. 208,398, filed Nov. 19, 1980 and assigned to the same assignee as the present application.

BACKGROUND ART

It is known that with closures having a metal shell and a depending skirt that the shell should include a liner made of a synthetic resin which is press-molded to the underside of the shell in order that the closure may obtain a tight seal with a container opening. A variety of liner shapes press-molded to the underside of a metal shell have been proposed. We have found that one desirable shape of a liner includes at least one circular projecting rim adapted to tightly seal with the surface of a container opening such as the liner disclosed in Japanese Patent Early Disclosure No. 53-65184 published in the 1978 Japanese Patent Gazette.

It is known that the cost of a closure construction such as described in the aforementioned Japanese Early Disclosure and pending application can be kept low if the liner can be manufactured as a single unit and if the amount of synthetic resin material used in forming the liner can be minimized. Usually the outside circumferential surface of the projecting rim of the liner is positioned to establish an interior space along a radial axis extending between the liner and the skirt of the shell (in situations where the liner itself has two or more projecting rims, the outer circumferential surface is established on the outermost projecting rim), and this space is contained between the outside circumferential surface of the liner and the inside surface of the shell skirt. If the space is large, then the required quantity of synthetic resin material will be reduced, but as the thickness of the projecting rim along a radial axis decreases and the space itself increases, then the strength of the projecting liner rim will also decrease. This space between the outside circumferential surface of the projecting liner rim and the inside of the metal shell skirt is thus limited in range by the size or degree of space required.

Under these circumstances, prior liners have been press-molded to a shell's underside surface in such a shape as shown in FIG. 1. Where the closure shown comprises a shell 2 formed from a sheet of some suitable metal such as aluminum alloy, tin plate, chromed steel, etc. and a liner 4 formed from an appropriate synthetic resin such as polyethylene, polyolefin, etc. The metal shell 2 has a circular upper surface 6 and a skirt 8 which depends from the circumference of the circular upper surface 6 (only a portion of this skirt is shown in Drawing 1). Based on typical methods of manufacturing for this type of closure, a liner 4 can be press-molded to the underside of the circular upper surface of the shell, and this liner has at least one downwardly projecting rim, or as shown in FIG. 1, two concentric projecting rims including an outer circular projecting rim 10 and an inner circular projecting rim 12. Such methods of manufacturing are described in Japanese Patent No. 40-13156 in Patent Gazette 1965, No. 41-5588 in Patent Gazette 1966, No. 48-5706 in Patent Gazette 1973 and No. 48-19886 in Patent Gazette 1974, and also in U.S. Pat. Nos. 3,135,019; 3,212,131 and 3,278,985. Circular projecting rims 10 and 12 are situated in the closure so that they are adapted to tightly contact a container opening (not shown in Drawing 1) by closing against the outer circumferential surface, top surface or inner circumferential surface of the opening thus causing the container to be tightly sealed. The outside circumferential surface of the outer projecting rim 10 of the liner 4 is positioned so as to create a space extending inwardly along a radial axis extending an appropriate distance $d_1$ from the inside circumferential surface at the beginning point of the skirt 8 of the metal shell 2 with the result that the space extends between the outside circumferential surface of the outer projecting rim 10 and the inside circumferential surface of the metal shell skirt 8.

We have discovered several problems which exist in closures constructed as shown in FIG. 1. With the liner configuration of FIG. 1, provision must be made to adhere the liner to the underside of the circular surface 6 of the metal shell when it is press-molded as well as afterwards. We have found that based on the time which elapses from the moment when the liner is press-molded, there is a tendency for the outer edge of the liner to gradually peel off from the underside of the circular surface of the metal shell. The reasons why such frequent peeling occurs have not been precisely determined, but it may originate from the pressure under which the liner material flows when the liner is press-formed. When the liner is press-formed in the shape shown in FIG. 1, a residual stress is imparted which remains in the liner to act along a radial axis as shown by directional arrow 14. We believe that the outer edge of the liner tends to peel away from the circular surface of the metal shell because of such residual stress acting in concentration on the outer projecting rim 10 and the inner projecting rim 12.

It is known that when a closure which has a liner with the configuration shown in FIG. 1 is installed on the mouth of a container to close it tightly, due to a variety of reasons, a relatively large amount of stress is added to the liner projecting rims 10 and 12 thus resulting in a fair amount of cracking of the rims. However, if the liner properly contacts the circular surface, there will be few problems when this type of cracking develops because the inside of the container extends to the region where the cracking and peeling off occurs. However if peeling takes place as described above and the region where the cracking and peeling occurs inside the container also extends to the outside of the container, a tight seal on the mouth of the container will be destroyed.

It is therefore an object of our invention to provide for a closure construction having a liner configuration which will prevent peeling of the outer edge of the liner from a circular surface of a metal shell over a period of time.

GENERAL DESCRIPTION OF THE INVENTION

We have discovered that peeling can be adequately prevented over a period of time if a liner is press-molded into a shape having thin tabs projecting outwardly along radial extending axes from the outer circumferential surface of a projecting rim (the outermost projecting rim in situations where there are two or more separate projecting rims). In such liners there is very little increase in the amount of synthetic resin material needed to form the liner and the adherence characteristic of the liner on the circular surface of the metal shell is remarkably improved.

Broadly a closure constructed according to our invention includes a metal shell having a circular top surface and a cylindrical skirt depending from a peripheral edge of the surface. A circular synthetic resin liner is press formed on the inside top surface with the liner having at least one concentric annular projection adapted to seal with the outer radial surface of a container opening. The diameter of the annular projection is less than the diameter of the top surface so that a space is formed between the outer edge of the projection and an inside surface of the skirt. A thin projecting tab extends radially outwardly of the projection into the space.

BEST MODES FOR CARRYING OUT THE INVENTION

Figure 2:
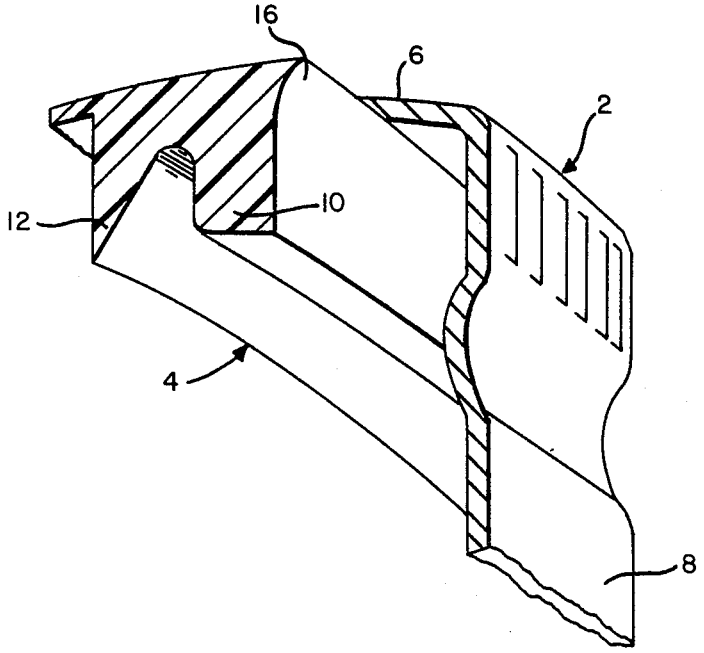
FIG. 2 is a partial perspective sectional view of a closure constructed according to the invention.
Figure 3:
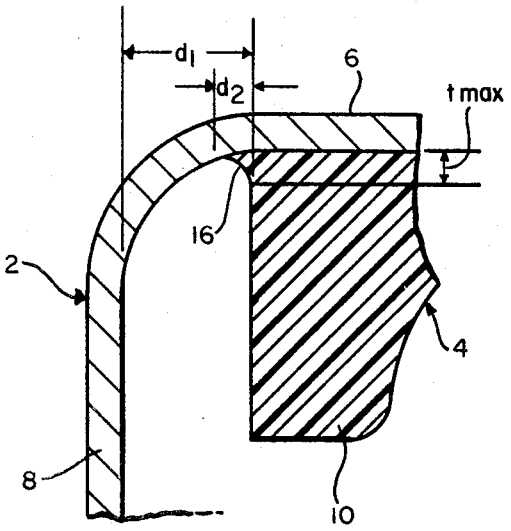
FIG. 3 is a partial cross-sectional view of the closure of FIG. 2.

Referring to Figures where like parts have like identifying numerals, and particularly to FIGS. 2 and 3, there is shown a closure constructed according to the invention having a metal shell 2 formed from a suitable sheet metal such as aluminum alloy, tin plate, chromed steel, etc. and a liner 4 formed from an appropriate synthetic resin such as polyethylene, polyolefin, vinyl chloride, etc. The metal shell 2 has a circular surface 6 as well as a skirt 8 which depends from the circumferential edge of the circular surface 6. The liner 4 can be press-molded to the underside of the shell's circular surface by previously described common techniques. The liner has at least one projecting rim and specifically two projecting rims as shown in FIG. 2 including an outer projecting rim 10 and an inner projecting rim 12. As illustrated in FIG. 3, the liner 4 is positioned so that an interior space is established along a radial axis extending between the outside circumferential surface of the liner outer projecting rim 10 and the inner surface portion of the skirt 8. This space between the outside circumferential surface of the outer projecting rim 10 and the inner surface portion of the skirt is large enough so that the amount of synthetic resin material needed to form the liner can be decreased. If this space is too large, then the thickness (along a radial axis) of the outer projecting rim 10 would inevitably decrease with the result that the strength of outer projecting rim 10 would also decrease causing the outer projecting rim 10 to collapse under an increased load when the closure is pressed against a container opening. To improve this weakness, the desired range of space $d_1$ along the radial axis between the outside circumferential surface of the liner, outer projecting rim 10 and the inner surface portion of the skirt 8 is generally from 0.50 to 5.00 mm and in particular within 0.70 to 3.50 mm.

The construction of this type of closure shown in the Figures is common knowledge, so only an abridged explanation of details will be presented. The following are the improvements in the shape of the press-molded liner 4 which can be included based on this invention. Essentially the liner 4 is press-molded to the inside surface of the metal shell 2 and is equipped with a thin projecting tab which extends outwardly along radial axes from a foundation on the outside circumferential surface of the outer projecting rim 10. In the construction as shown in FIGS. 2 and 3, the thin projecting tab 16 extends completely around the projecting rim circumference.

Figure 1:
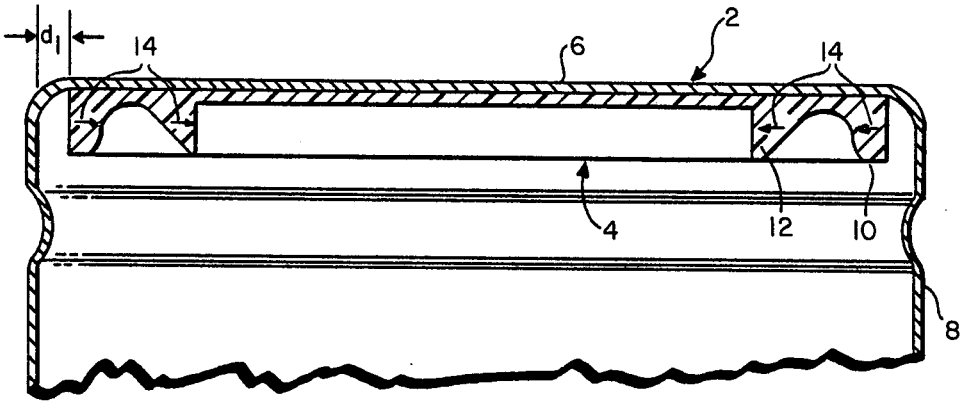
FIG. 1 (Prior Art)
FIG. 1 is a side sectional view of a prior art closure.

The improved closure liner of the invention equipped with a thin projecting tab as described above counteracts the residual stress which converges to act on the outermost projecting rim 10 and the inner projecting rim 12 of the liner 4 as explained previously with respect to prior art constructions shown in FIG. 1. This improved liner will adequately prevent the occurrence of peeling at the outer edge portion of the liner over a period of time by the binding energy of the thin projecting tab against the inside surface of the cover shell 2.

To prevent the occurrence of peeling over a period of time at the outer edge portion of the liner 4 in the manner described with reference to FIG. 1, the outer projecting rim 10 can be made to extend outwardly along a radial axis toward the inside surface of the skirt 8 so that the outer circumferential surface of the outer projecting rim 10 is caused to contact the inner surface of the skirt 8, or a projecting tab of an appropriate thickness can extend outwardly along radial axes from an outer circumference surface foundation on the outer projecting rim 10 to or near the inside surface of the skirt 8. While either of these formats are possible, the closure construction costs will increase in proportion to any increase in the amount of synthetic resin material required for forming the liner. In addition, one point which should be carefully considered is that if a projecting tab is used, the tab itself must be thick enough to accommodate for residual stress, for if any peeling occurs over time due to residual stress even with the presence of a projecting tab, then the peeling will not be prevented at the outside portion of the liner. Furthermore, a closure shape such as those indicated in FIG. 1 or FIGS. 2 and 3, often becomes deformed on the inside of the radial axis at the shoulder of the shell 2 (that is, at the region of the shell where the skirt comes down from the circular surface edge of the shell) when the closure is fitted to a container opening. A liner's resistance increases against any added deformation based on the thickness of the projecting tab.

For these reasons, it is important that a projecting tab which protrudes along a radial axis from the foundation portion of the outside circumferential surface of the outer projecting rim be thin. Therefore the thickness of the thin projecting tab should gradually taper down outwardly along a radial axis. A suitable thickness $t_{max}$ for the innermost portion along the radius axes of such a thin projecting tab is 0.10 to 1.00 mm and particularly within 0.15 to 0.40 mm. The outside of the thin projecting tab as shown in FIGS. 2 and 3 (that is, the underside as shown in FIGS. 2 and 3) is set by the curvature of the rounded surface suitable for conforming to the underside of the shell, so the thickness of the thin projecting tab gradually decreases from its point of maximum thickness $t_{max}$ at the foundation portion of the outside circumferential surface of the outer projecting rim 10 outwardly along radial axes to a point where the tapered edge of the thin projecting tab meets the underside of the shell.

From the standpoint of effectively preventing the occurrence of peeling over a period of time as described above, the length of the projection of the thin projecting tab, that is to say, the length $d_2$ which it projects outwardly along a radial axis from the foundation portion of the outside circumference of the outer projecting rim keeps in check any increase in the amount of synthetic resin material required to form the liner. A suitable range of length would be a little smaller than the space along a radial axis between the foundation of the outside circumferential surface of the outer projecting rim 10 and the inside of the skirt. This range is from 0.10 to 3.00 mm or particulaarly within 0.20 to 1.00 mm (for, as previously described, the most appropriate distance of the inside space is from 0.50 to 5.00 mm or within 0.70 to 3.50 mm in particular).

Figure 4:
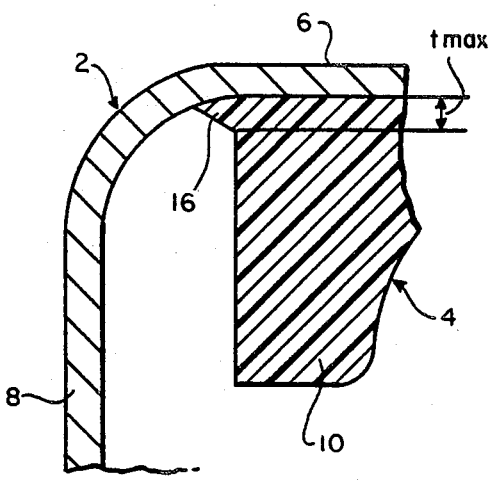
FIG. 4 is a partial cross-sectional view of a further embodiment of a closure constructed according to the invention.

FIG. 4 illustrates a liner shape for a further embodiment of the invention. The outside surface of the thin projecting tab 16 of the embodiment shown in FIG. 4 (that is, the underside of the tab in FIG. 4) is not curved, and the edge of the thin projecting tab which extends outwardly along a radial axis from the foundation portion of the outside circumferential surface of the outer projecting rim 10 to the incline toward the underside of the shell 2 is governed by a plane that conforms to the shell underside, so the thickness of this thin projecting tab gradually decreases outwardly along a radial axis from its maximum thickness $t_{max}$ at the innermost point of the radial axis (where the thin projecting tab begins on the outside circumference surface of the outer projecting rim).

Figure 5:
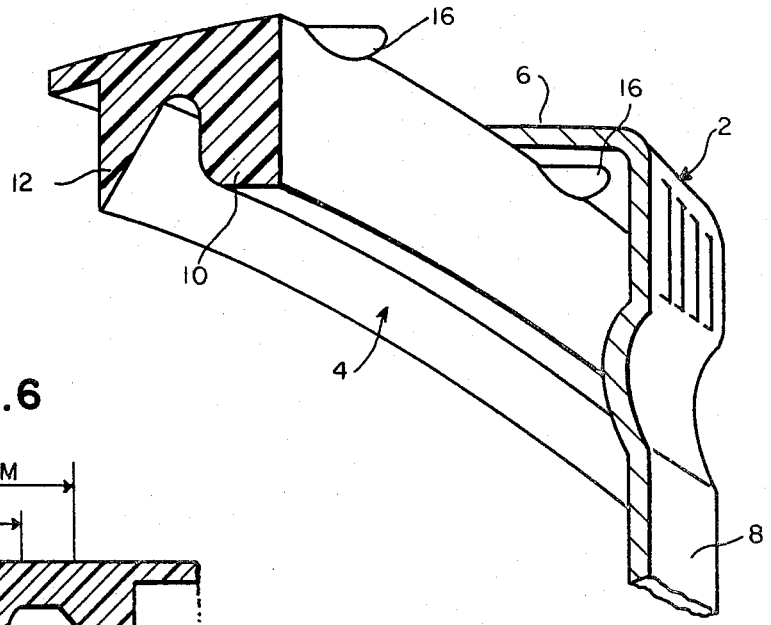
FIG. 5 is a partial cross-sectional view of a still further embodiment of a closure constructed according to the invention.

FIG. 5 illustrates the liner configuration of a still further embodiment of this invention. The thin projecting tabs 16 of the liner in the example shown in FIG. 5 are composed of a number of individual units which extend outwardly along radial axes from foundation portions of the outside circumferential surface of the outer projecting rim 10 and are circumferentially spaced around the outer projecting rim. As FIG. 5 indicates, when a gradual decrease in thickness outwardly along radial axes is included for the number of individual tab units which comprise the thin projecting tabs, it is useful if there is a gradual decrease in thickness on both sides of the tab curvature or a uniform tapering toward the edge of the tab's semi-circular circumference. The width of the semi-circular circumference of each of the units that comprise the thin projecting tabs 16 as shown in FIG. 5 also gradually decreases outside along a radial axis.

EXAMPLES AND COMPARATIVE EXAMPLE

An 0.24 mm thick aluminum-base alloy plate was painted with a vinyl-related protective lacquer and printed on one side, while the other side was painted with an epoxy paint containing polyethylene oxide. This metal sheet was then submitted to a press operation where the side painted with the epoxy paint containing polyethylene oxide became the underside, and the sheet was pressed into the metal shell configuration as indicated in FIGS. 1 through 5. Next a high pressure polyethylene (0.92 density, 4.0 melt index) was melted at 220° C. and introduced to the underside of the metal shell which had been heated to approximately 180° C. and was then press-molded into a liner whose shape has been indicated in FIGS. 2 and 3 to construct the closure of Example 1 of this invention. The respective dimensions of the closure sections were as follows:

Distance $d_1$ along radius axis between foundation portion of outside circumference surface of outer projecting rim and inside of lower portion of skirt—0.90 mm, Thin projecting tab length $d_2$ along radius axis—0.25 mm, Maximum thickness $t_{max}$ of thin projecting tabs at innermost side along radius axis—0.25 mm.

The closure in Example 2 of this invention is identical in liner shape to that of Example 1, except for the tab construction. The liner of the closure in Example 2 of this invention possesses thin projecting tabs composed of sixteen individual units spaced equi-distant from one another completely around the liner projecting rim. The width of the distance between each of the thin projecting tabs around the outer liner projecting rim circumference was determined by the distance between a radial axis along the center of each tab, as 0.23 mm.

The comparison example closure was similar to that shown in FIG. 1 and had the same dimensions as the closure examples 1 and 2 except for the tab construction.

To understand the degree of peeling due to the effects of the passage of time on the liners in Examples 1 and 2 of this invention, tests were conducted on liner shapes both one week and one month after manufacture, with the following results.

Figure 6:
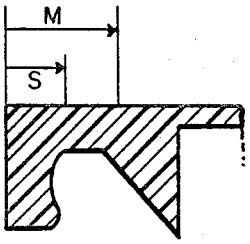
FIG. 6 is a cross-sectional view of a liner to clarify the degree of peeling in Examples 1 and 2 of the specification.

For the purpose of investigating the degree of peeling caused by the elapse of one week and one month intervals, container covers in Examples 1 and 2 were assigned n=100. A mixture of dye paint in an ethanol solution was injected by hypodermic syringe into the space between the inside surface of the shell skirt and the outside circumference surface of the liner projecting rim. The dye paint would not adhere to the underside of the shell wherever the liner had made tight contact, so after the ethanol solution evaporated, the degree of peeling from the shell underside could be recognized by the size of the area of dye paint sticking to the shell underside. At this time the degree of peeling or 'S' was the dye paint which adhered to the area indicated by 'S' in FIG. 6 of the outside circumference surface of the outer projecting rim, while 'M' was the dye paint which adhered to the area indicated by 'M' in the same Figure. The results are shown in Table 1.

TABLE 1

| Degree of Peeling | Example 1 | | Example 2 | | Comparative Example | |
|---|---|---|---|---|---|---|
| Time | S | M | S | M | S | M |
| One Week | 0 | 0 | 3 | 0 | 18 | 62 |
| One Month | 0 | 0 | 4 | 0 | 20 | 63 |

We claim:

1. A closure including a metal shell having a circular top surface, a substantially cylindrical skirt depending from the peripheral edge of the top surface, and a synthetic resin circular liner press formed on the inside top surface of the shell with the liner having at least one concentric annular projection adapted to seal with a container opening where the diameter of the circular liner is less than the diameter of the circular top surface whereby a radially extending space is formed between an outer edge of the projection and an inside surface of said skirt; the improvement comprising in having a plurality of thin projecting tabs circumferentially spaced about the circumference of said liner with each tab having a length extending radially outwardly of said annular projection in said space.

* * * * *